US008715014B2

(12) United States Patent
Yeon

(10) Patent No.: US 8,715,014 B2
(45) **Date of Patent: *May 6, 2014**

(54) CONNECTOR UNIT AND DISPLAY DEVICE HAVING THE SAME

(71) Applicant: Samsung Display Co., Ltd., Yongin (KR)

(72) Inventor: Yeun-Mo Yeon, Hwaseong-gun (KR)

(73) Assignee: Samsung Display Co., Ltd. (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/907,104

(22) Filed: May 31, 2013

(65) Prior Publication Data

US 2013/0260616 A1 Oct. 3, 2013

Related U.S. Application Data

(63) Continuation of application No. 12/544,248, filed on Aug. 20, 2009, now Pat. No. 8,460,037.

(30) Foreign Application Priority Data

Aug. 22, 2008 (KR) ..... 10-2008-0082372

(51) Int. Cl.
*H01R 13/64* (2006.01)

(52) U.S. Cl.
USPC ..... 439/680

(58) Field of Classification Search
USPC ..... 439/680, 681; 385/147
See application file for complete search history.

(56) References Cited

U.S. PATENT DOCUMENTS

| | | | | |
|---|---|---|---|---|
| 4,580,868 | A | 4/1986 | Verstijnen | |
| 6,733,343 | B2 | 5/2004 | Morita et al. | |
| 7,462,067 | B1 | 12/2008 | Whiteman, Jr. et al. | |
| 8,460,037 | B2 * | 6/2013 | Yeon | 439/680 |

FOREIGN PATENT DOCUMENTS

| | | | |
|---|---|---|---|
| CN | 2618330 | Y | 5/2004 |
| CN | 2891374 | Y | 4/2007 |
| JP | 62-191185 | U | 12/1987 |
| JP | 4-52389 | U | 5/1992 |
| JP | 06168761 | A | 6/1994 |
| JP | 09035830 | A | 2/1997 |
| JP | 10154552 | A | 6/1998 |
| JP | 2001244006 | A | 9/2001 |
| JP | 2002203641 | A | 7/2002 |
| JP | 2002280100 | A | 9/2002 |
| JP | 2002346065 | A | 12/2002 |
| JP | 2003031316 | A | 1/2003 |
| JP | 2007234971 | A | 9/2007 |

* cited by examiner

*Primary Examiner* — Phuong Dinh
(74) *Attorney, Agent, or Firm* — Cantor Colburn LLP

(57) ABSTRACT

A connector unit is connectable to a printed circuit board ("PCB") and includes a first connector and a second connector. The first connector includes a first connector body having a receiving hole at one side, and a first terminal part disposed inside the receiving hole. The second connector includes a second connector body, and first and second fixing protrusions. The second connector body has a second terminal part formed at a first side. The second terminal part is inserted in the receiving hole, and is electrically connected to the first terminal part. First and second fixing protrusions are disposed at top and bottom surfaces of the second connector body, and are fixed to upper and lower edges of the receiving hole.

20 Claims, 8 Drawing Sheets

CONNECTOR UNIT AND DISPLAY DEVICE HAVING THE SAME

This application is a continuation of U.S. patent application Ser. No. 12/544,248, filed on Aug. 20, 2009, which claims priority to Korean Patent Application No. 2008-82372, filed on Aug. 22, 2008, and all the benefits accruing therefrom under 35 U.S.C. §119, the contents of which in its entirety are herein incorporated by reference.

BACKGROUND OF THE INVENTION

1. Field of the Invention

The present invention relates to a connector unit and a display device having the connector unit, which is capable of enhancing product reliability.

2. Description of the Related Art

Generally, a liquid crystal display ("LCD") device includes an LCD panel which displays an image using light transmittance of liquid crystal, a backlight assembly which is disposed at the bottom of the LCD panel and supplies the LCD panel with light, and a panel driving unit which drives the LCD panel.

The panel driving unit includes a source printed circuit board ("PCB") transmitting a data signal to the LCD panel, and a gate PCB transmitting a gate signal to the LCD panel.

The source PCB is connected to an external PCB through a connector. The external PCB supplies an image signal and a control signal to the LCD panel to drive the LCD panel. The connector includes a first connector mounted on the source PCB, and a second connector which is inserted in the first connector.

Each of the first and second connectors has a symmetrical shape, so that a user may find it difficult to easily perceive the connection direction, and thus the second connector may be mistakenly inserted into the first connector the wrong way. In a case where the second connector is wrongly inserted, a connector pin may be bent by improper insertion or a circuit may be lost due to a short circuit in a power supply part.

BRIEF SUMMARY OF THE INVENTION

Aspects, features and advantages of the present invention provide a connector unit capable of enhancing product reliability.

Also, the present invention provides a display device having the exemplary connector unit.

According to one exemplary embodiment of the present invention, a connector unit includes a first connector and a second connector. The first connector is connectable to a printed circuit board ("PCB"), includes a first connector body having a receiving hole at one side, a first terminal part disposed inside the receiving hole. The second connector includes a second connector body, first and second fixing protrusions. The second connector body has a second terminal part disposed at a first side. The second terminal part is inserted in the receiving hole, and is electrically connected to the first terminal part. Fixing protrusions are disposed on at least one of top and bottom surfaces of the second connector body, and are fixed to one of upper and lower edges of the receiving hole.

The fixing protrusions include a first fixing protrusion and a second protrusion, and the first fixing protrusion is disposed at opposite sides of an edge of the top surface contacting a second side of the second connector body, and the second side is opposite to the first side, and the second fixing protrusion is disposed at the center of an edge of the bottom surface contacting the second side. Also, the first connector further comprises a first fixing groove and a second fixing groove. The first fixing groove corresponding to the first fixing protrusion is disposed at both sides of an upper edge of the receiving hole. The second fixing groove corresponding to the second fixing protrusion is disposed at the center of a lower edge of the receiving hole.

The first fixing protrusion is disposed at one side of an edge of the top surface contacting the second side of the second connector body which is opposite to the first side, and the second fixing protrusion is disposed at the bottom surface contacting the second side, and in particular is disposed at the second side opposite to the first side of a top surface where the first fixing protrusion is disposed. The width of the first fixing protrusion and the width of the second fixing protrusion are different from each other in a width direction of the second connector substantially perpendicular to an insertion direction of the receiving hole.

The first connector further comprises a first fixing groove and a second fixing groove. The first fixing groove corresponding to the first fixing protrusion is disposed at one side of an upper edge of the receiving hole. The second fixing groove corresponding to the second fixing protrusion is disposed at a lower edge of the receiving hole, and in particular is disposed at the second side opposite to the first side of the upper edge.

The first fixing protrusion is disposed along an entire edge of the top surface contacting the second side of the second connector body opposite to the one side, and the second fixing protrusion is disposed at the center of an edge of the bottom surface contacting the second side.

The first connector further comprises a first fixing groove and a second fixing groove. The first fixing groove corresponding to the first fixing protrusion is disposed along an entire upper edge of the receiving hole. The second fixing groove corresponding to the second fixing protrusion is disposed at the center of a lower edge of the receiving hole.

Also, the present invention provides a display device including a display panel, a PCB and a connector unit. The display panel displays an image. A panel driving part which outputs an image signal to the display panel is mounted on the PCB. The connector unit includes a first connector and a second connector. The first connector body is combined to the PCB, and has a receiving hole is disposed at a first side of the first connector body. The first connector has a first terminal part disposed inside the receiving hole. The second connector body has a second terminal part at a first side, and the second terminal part is electrically connected to the first terminal part, and is inserted in the receiving hole. The second connector has first and second fixing protrusions which are disposed at a top surface and bottom surface of the second connector body and the first and second fixing protrusion are fixed to upper and lower edges of the receiving hole.

The PCB includes a groove which is disposed at one side; the first connector is connected to the groove disposed at the PCB.

According to the connector unit and the display device having the connector unit, a user may easily perceive the connection direction/orientation of the first connector and the second connector, so that the second connector may be correctly connected to the first connector.

Thus, the connector unit may enhance product reliability.

BRIEF DESCRIPTION OF THE DRAWINGS

The present invention will be will become more apparent by describing in further detail exemplary embodiments thereof with reference to the accompanying drawings, in which.

DETAILED DESCRIPTION OF THE INVENTION

Figure 1:
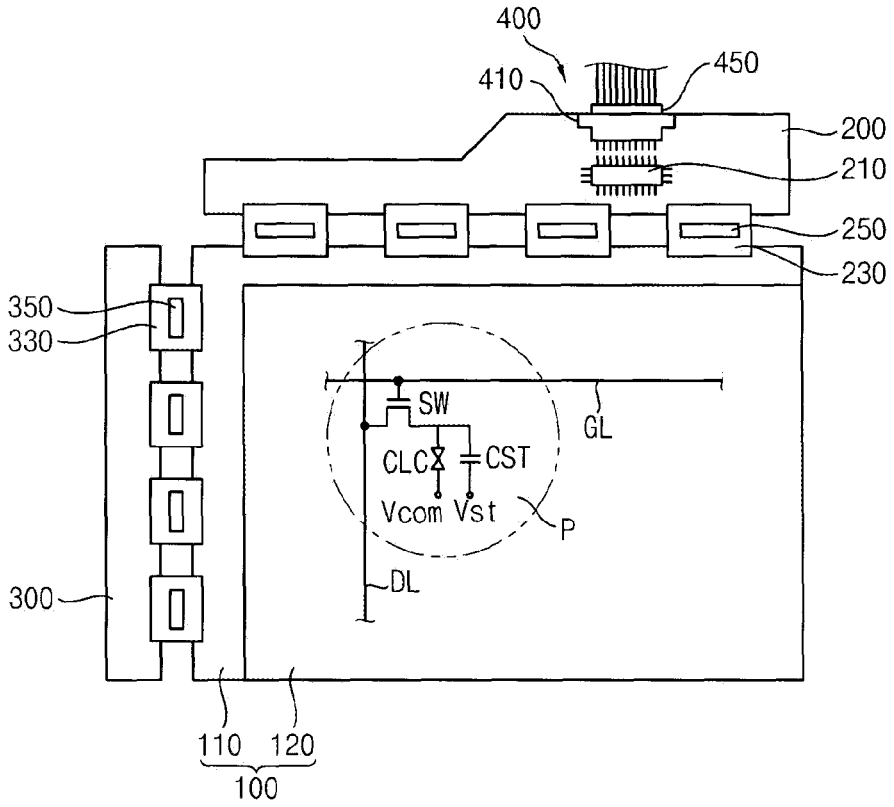
FIG. 1 is a top plan view illustrating one exemplary embodiment of a display device in accordance with the present invention.

The present invention is described more fully hereinafter with reference to the accompanying drawings, in which exemplary embodiments of the present invention are shown. The present invention may, however, be embodied in many different forms and should not be construed as limited to the exemplary embodiments set forth herein. Rather, these exemplary embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to cross-sectional illustrations that are schematic illustrations of idealized exemplary embodiments (and intermediate structures) of the present invention. As such, variations from the shapes of the illustrations as a result, for example, of manufacturing techniques and/or tolerances, are to be expected. Thus, exemplary embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
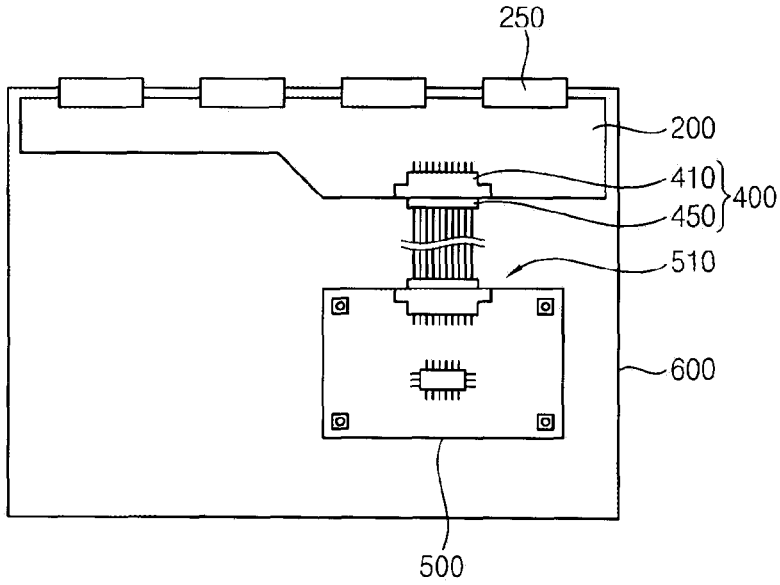
FIG. 2 is a rear plan view illustrating the display device in FIG. 1 with a source printed circuit board ("PCB") folded over.

FIG. 1 is a top plan view illustrating one exemplary embodiment of a display device in accordance with the present invention. FIG. 2 is a rear plan view illustrating the display device in FIG. 1 with a source printed circuit board ("PCB") folded over.

Referring to FIGS. 1 and 2, the display device includes a display panel 100, the source printed circuit board ("PCB") 200, a gate PCB 300 and a connector unit 400 combined to the source PCB 200.

The display panel 100 may include an array substrate 110 having a thin film transistor, a color filter substrate 120 having a common electrode and color filters, a liquid crystal layer (not illustrated) disposed between the array substrate 110 and the color filter substrate 120.

A plurality of data lines DL and a plurality of pixel units P are formed at the array substrate. The plurality of data lines DL is extended in a perpendicular direction from each other, the plurality of pixel units P is electrically connected to a plurality of gate lines GL. Each of the pixel units P includes a switching element SW, a liquid crystal capacitor CLC and a storage capacitor CST. The switching element SW includes a thin film transistor, and supplies a data signal with the liquid capacitor CLC and the storage capacitor CST. The data signal is transmitted through the data line when a gate signal transmitted through the corresponding gate line. The liquid crystal capacitor CLC, which is electrically connected to the switching element SW (e.g., thin film transistor ("TFT")) and a common electrode (not illustrated) supplying a common voltage Vcom, stores a voltage corresponding to the data signal. The storage capacitor CST, which is electrically connected to the TFT and a storage electrode supplying a storage voltage Vst, stores a voltage corresponding to the data signal.

The display panel 100 is separately connected to the source PCB 200 and the gate PCB 300 through a data driving circuit film 230 and a gate driving circuit film 330, respectively. Each of the data driving circuit film 230 and the gate driving circuit film 330 is comprised of a tape carrier package ("TCP") or a chip on film ("COF"). Also, a gate driving circuit may be directly formed on the array substrate 110 of the display panel 100 after the gate PCB 300 through a data driving circuit film 230 are eliminated.

The source PCB 200 is electrically connected to the display panel 100. A main driving circuit 210 is mounted on the source PCB 200. The main driving circuit 210 is electrically connected to an external PCB 500 through the connector unit 400. The main driving circuit 210 receives a control signal and an image signal from the external PCB 500 through the connector unit 400.

The main driving circuit 210 generates a data control signal which controls driving of the data driving circuit 230, a gate control signal which controls driving of the gate driving circuit film 330 based on the control signal. The data control signal may include a horizontal start signal, a reverse signal and an output enable signal. The gate control signal may include a vertical start signal, a gate clock signal and output enable signal.

The source PCB 200 is mounted on the backside of a backlight assembly by bending of the data driving circuit film 230, as illustrated in FIG. 2. A groove (see "210" in FIG. 5) to which the connector unit 400 is combined may be formed at the source PCB 200.

The connector unit 400 is combined to the source PCB 200 to be placed at the groove. The connector unit 400 is comprised of a first connector 410 and a second connector 450 connected to the first connector 410. The first connector 410 is physically and electrically combined with the groove formed at the source PCB 200

The first connector 410 includes a first connector body having a receiving hole at one side and a first terminal disposed inside the receiving hole. The second connector 450 is inserted in the receiving hole, includes a second connector body having a second terminal, and first and second fixing protrusions. The second terminal which is electrically connected to the first terminal is formed at the second connector body. The first and second fixing protrusions, which are fixed to the upper and lower side edges of the receiving hole, are formed at top and bottom surfaces of the second connector body. A detailed description of the connector unit 400 including the first connector 410 and second connector 450 will be provided later.

A data driving chip 250 is mounted on the data driving circuit film 230. A first end of the data driving circuit film 230 is electrically connected to the source PCB 200, and a second end of the data driving circuit film 230 is electrically connected to the display panel 100. The data driving chip 250 receives the image signal and data control signal from the main driving circuit 210, and supplies an analog data voltage which is converted through the image signal based on the data control signal to the display panel 100.

A gate driving chip 350 is mounted on the gate driving circuit film 330. The gate PCB 300 is electrically connected to the source PCB 200 through a signal line, receives the gate control signal from the source PCB through the signal line. The gate driving chip 350 receives the gate control signal through the gate PCB 300, and supplies the gate control signal to the display panel 100.

Figure 3:
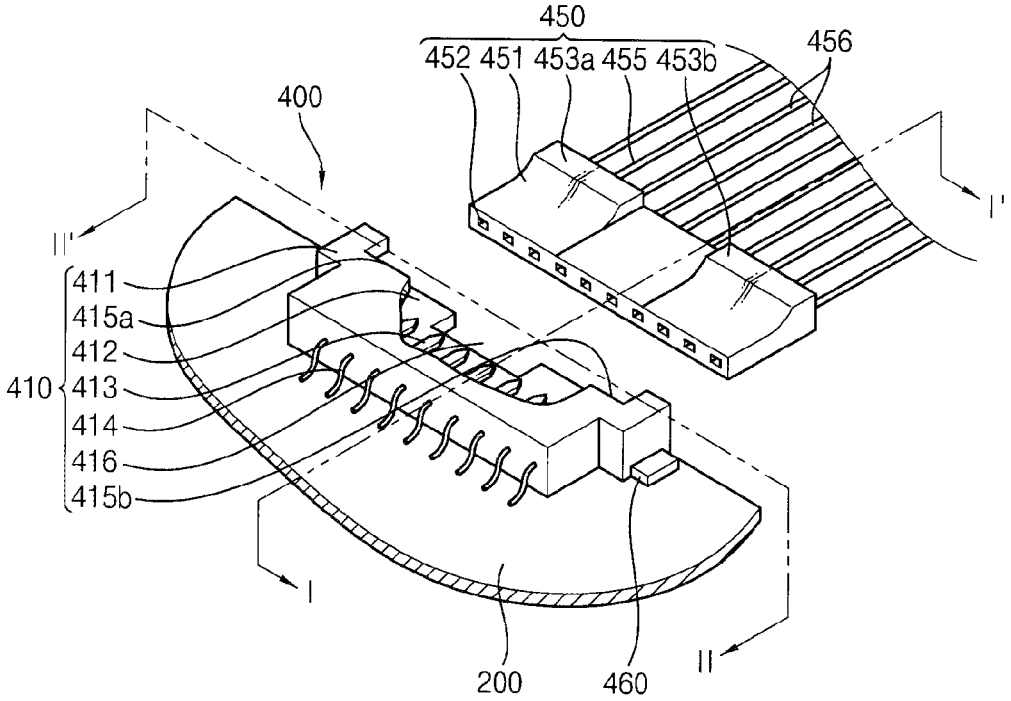
FIG. 3 is a perspective view illustrating a connector unit in FIG. 1.
Figure 4:
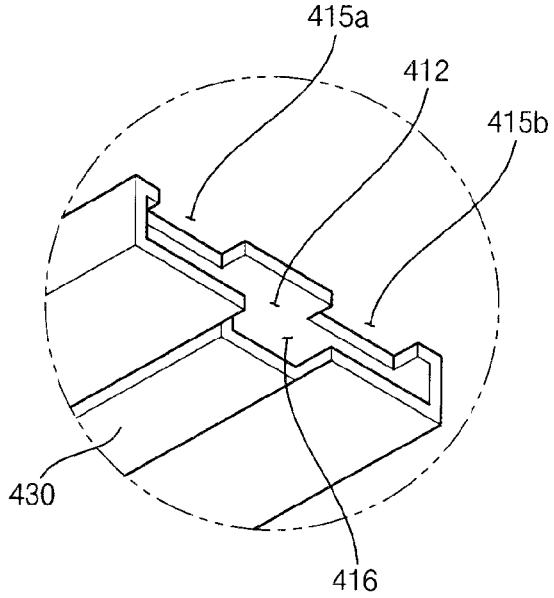
FIG. 4 is an enlarged partial perspective view illustrating a rear surface of a first connector of the connector unit in FIG. 3.

FIG. 3 is a perspective view illustrating the connector unit 400 in FIG. 1. FIG. 4 is an enlarged partial perspective view illustrating rear surface of the first connector 410 of the connector unit in FIG. 3.

Referring to FIGS. 3 and 4, the connector unit 400 includes the first connector 410 and the second connector 450.

The first connector 410 includes a first connector body 411 defining a receiving hole 412 and a first terminal 413.

The first connector body 411 has a rectangular parallelepiped shape which includes a bottom surface, side surfaces and a top surface. The bottom surface contacts the groove formed at the source PCB 200, a plurality of side surfaces is combined to the bottom surface and the top surface is combined to the side surfaces. A first side of the first connector body 411 has a receiving hole into which the second connector 450 is inserted.

The first terminal 413 is disposed inside the receiving hole 412. The first terminal 413 may include a plurality of pins. The plurality of pins protrudes toward the direction of the receiving hole 412 from a second side opposite to the first side. Hereinafter, the first terminal 413 is referred to as the pins.

The first connector 410 further comprises a plurality of first signal lines 414. First signal lines 414 protrude from an opposite side to the side where the first signal lines 414 are formed of the first connector body 411. A first end of the first signal lines 414 is connected to the pins 413 disposed inside the first connector body 411, a second end which is opposite to the first end is connected to signal lines of the source PCB 200 by a solder (not illustrated).

Also, a guide part 430 guiding the source PCB 200 may be formed at the first connector body 411. In FIG. 4, the guide part 430 is formed to have substantially the same width as a second fixing groove 416 at the bottom surface of the first connector body 411, and protrudes to a certain height. The guide part 430 is disposed at a bottom surface of the first connector body 411, is formed to have substantially the same height as a thickness of the source PCB 200 which is combined to opposite ends of the bottom surface of the first connector body 411.

Figure 5:
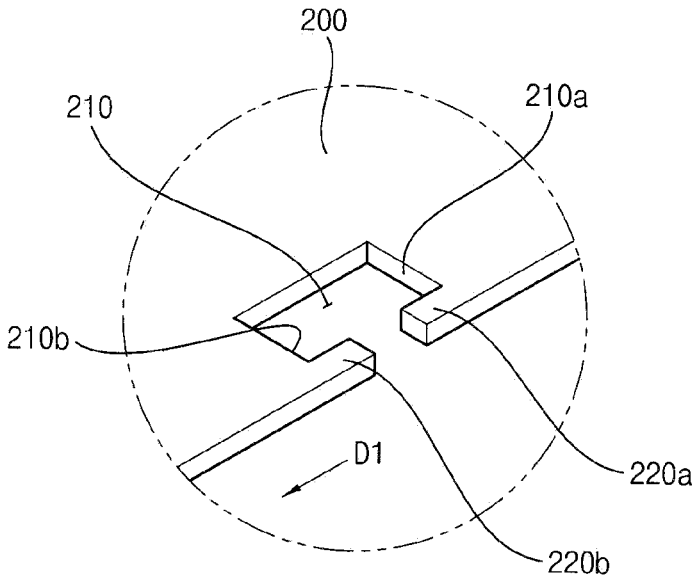
FIG. 5 is a perspective view illustrating the source printed circuit board ("PCB") in FIG. 3.

FIG. 5 is a perspective view illustrating the source PCB 200 in FIG. 3.

Referring to FIG. 5, the groove 210 is formed at the source PCB 200. The source PCB 200 includes a first connection part 220*a* and a second connection part 220*b*. The first connection part 220*a* and the second connection part 220*b* are connected with both ends of the bottom surface of the first connector body 411. The first connection part 220*a* is extends in a first direction D1 from a first side 201*a* of the groove 210, the second connection part 220*b* extends toward the first connection part 220*a* in a direction from a second side 210*b* of the groove 210 which is opposite to the first side 210*a*.

The first connector 410 is combined to the source PCB 200, the first and second connection parts 220*a* and 220*b* are disposed along the bottom surface of the first connector body 411, and are fixed to the guide part 430.

A part of the bottom surface of the first connector body 411 may be combined to the first and second connection parts 220*a* and 220*b* of the source PCB 200 through solder or an anisotropic conductive film (not shown). The anisotropic conductive film includes an adhesive material and a conductive particle formed at the adhesive material.

Figure 6:
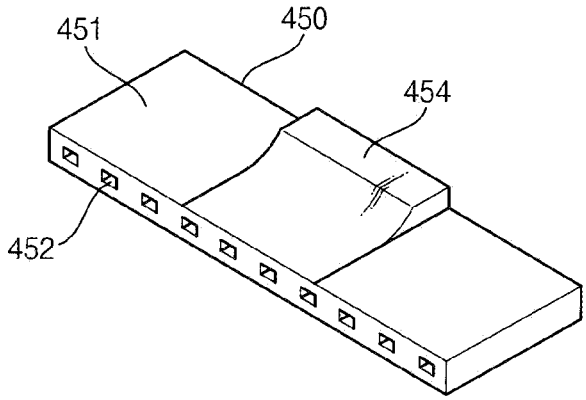
FIG. 6 is a perspective view illustrating a rear surface of a second connector of the connector unit in FIG. 3.

FIG. 6 is a perspective view illustrating a rear surface of a second connector in FIG. 3.

Referring to FIGS. 3 and 6, the second connector 450 includes a second connector body 451, a first fixing protrusion 453*a* and 453*b* and a second fixing protrusion 454.

The second connector body 451 has a rectangular parallelepiped shape which includes a bottom surface, side surfaces and a top surface, the side surfaces connect the bottom surface with the top surface. The second connector body 451 includes a second terminal part 452. The second terminal part 452 is formed at a first side of the second connector body 451 facing the pins 413 corresponding to the first terminal 413 of the first connector 410. The second terminal part 452 may include a plurality of pin holes into which the pins 413 are inserted and electrically connected. Hereinafter, the second terminal part 452 is referred to as pin holes.

The first fixing protrusion 453*a* and 453*b* is formed at the top surface of the second connector body 451. The first fixing protrusions 453*a* and 453*b* are formed at the opposite sides of an edge at the top surface contacting a second side opposite to the first side where the pin holes 452 are formed.

The second fixing protrusion 454 may be formed at the bottom surface of the second connector body 451.

Referring to FIG. 6, the second fixing protrusion 454 is formed at the center of an edge at the of bottom surface contacting the second side opposite to the first side having the first fixing protrusions 453*a* and 453*b*.

Referring to FIG. 3, the second connector 450 further comprises a plurality of second signal lines 456. A first end of the second signal lines 456 is electrically connected to a connection terminal (not shown) which is disposed inside the pin holes 452 and a second end of second signal lines 456 is electrically connected to a connector 510 formed at the external PCB 500 (see FIG. 2).

Figure 7A:
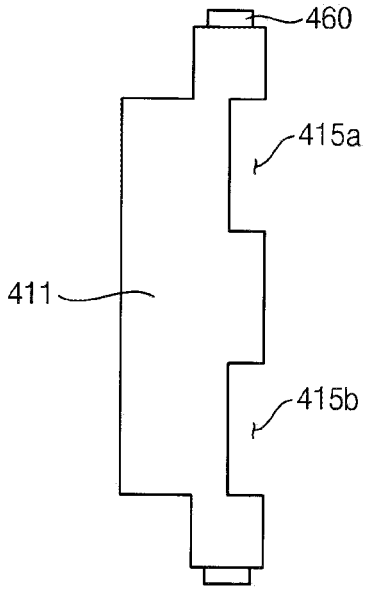
FIGS. 7A to 7B are top plan views illustrating the first and second connectors, respectively, of the connector unit in FIG. 3.
Figure 7B:
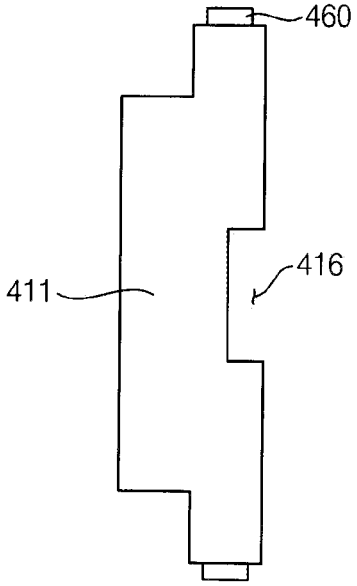

FIGS. 7A and 7B are top and bottom plan views illustrating the first connector 410 in FIG. 3. In particular, FIG. 7A illustrates a top surface of a first connector body 411. FIG. 7B illustrates a bottom surface of a first connector body 411.

Referring to FIG. 3 and FIGS. 7A and 7B, the first connector 410 further comprises first fixing grooves 415*a* and 415*b* and a second fixing groove 416. The first fixing grooves 415*a* and 415*b* are formed at a top surface edge of the first connector body 411 and the second fixing groove 416 is formed at a bottom surface edge of the first connector body 411.

Referring to FIGS. 3 and 7A, the first fixing grooves 415*a* and 415*b* are formed at both sides of an upper edge of the receiving hole 412 of the first connector 410 corresponding to the first fixing protrusions 453*a* and 453*b* of the second connector 450. Referring to FIGS. 6 and 7B, the second fixing groove 416 is formed at the center of a lower edge of the receiving hole 412 of the first connector 410 corresponding to the second fixing protrusion 454 of the second connector 450.

Figure 8:
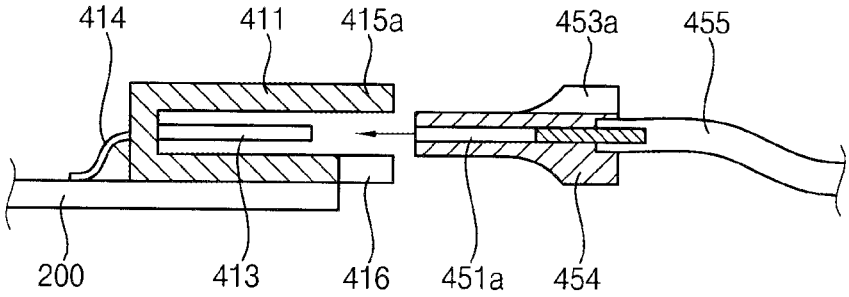
FIG. 8 is a cross-sectional view taken along line I-I' in FIG. 3.
Figure 9:
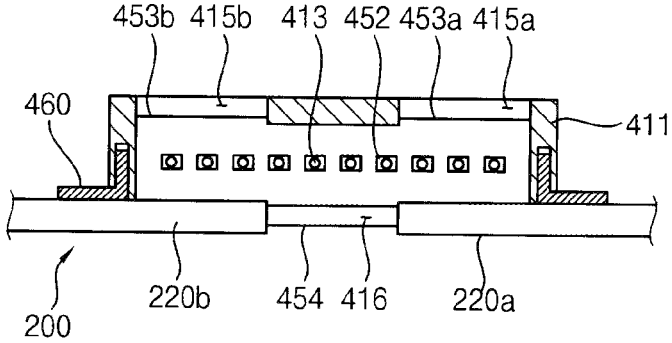
FIG. 9 is a cross-sectional view taken along line II-II' in FIG. 3.

FIG. 8 is a cross-sectional view taken along line I-I' of the connector unit 400 in FIG. 3. FIG. 9 is a cross-sectional view taken along line II-II' of the connector unit 400 in FIG. 3.

Referring to FIGS. 3, 8 and 9, the second connector 450 is connected to the first connector 410. The second connector body 451 is inserted in the receiving hole 412 of the first connector 410. The pins 413 disposed at the receiving hole 412 of the first connector 410 are inserted in the pin holes 452 formed at the second connector body 451 thereby electrically connecting the first connector 410 with the second connector 450.

Also, as the second connector body 451 is inserted in the receiving hole 412 of the first connector 410, the first fixing protrusion 453*a* and 453*b* formed at the second connector 450 are fixed to the first fixing groove 415*a* and 415*b* formed at the first connector 410, and the second fixing protrusion 454 is fixed to the second fixing groove 416.

The source PCB 200 is extended to a position, corresponding to a position where the first fixing groove 415*a* and 415*b* is located, and connected to both ends of bottom surface of the first connector body 411.

The first connector body 411 may be fixed to the source PCB 200 through a separate fixing member 460. The fixing member 460 fixes the first connector body 411 to the source PCB 200 by being combined with the solder or the anisotropic conductive film (both not shown).

A first end of the fixing member 460 is inserted in a connection groove formed at the side of the first connector body 411 and fixed. A second end of the fixing member 460 is fixed to a top surface of the source PCB 200 through the solder or anisotropic conductive film.

The shape of a top surface and lower surface at the second connector body 451 which is inserted in the first connector 410 may be shaped differently. However, in each case though the shape of the first connector 410 is made to correspond to the shape of the second connector 450, so that only one connection direction is possible. Connection errors of the first and second connectors 410 and 450 may be prevented.

Also, the guide part 430 of first connector 410 is disposed at the groove 210 which is formed at the source PCB 200, so that a total height of the first connector 410 is not obtrusive. In other words, the total height of the first connector 410, is less obtrusive as the guide part 430 thickness is consumed by the thickness of the source PCB 200.

Also, the first and second connection parts 220*a* and 220*b* of the source PCB 200 extend to correspond to a position of the first fixing groove 453*a* and 453*b* of the first connector body 411. In this manner, a separation of the first connector 410 and the source PCB 200 by an external force may be prevented or effectively reduced. That is, the first and second connection parts 220*a* and 220*b* of the source PCB 200 extend toward each other and abut a vertical flat surface of the second fixing protrusion 454.

Figure 10:
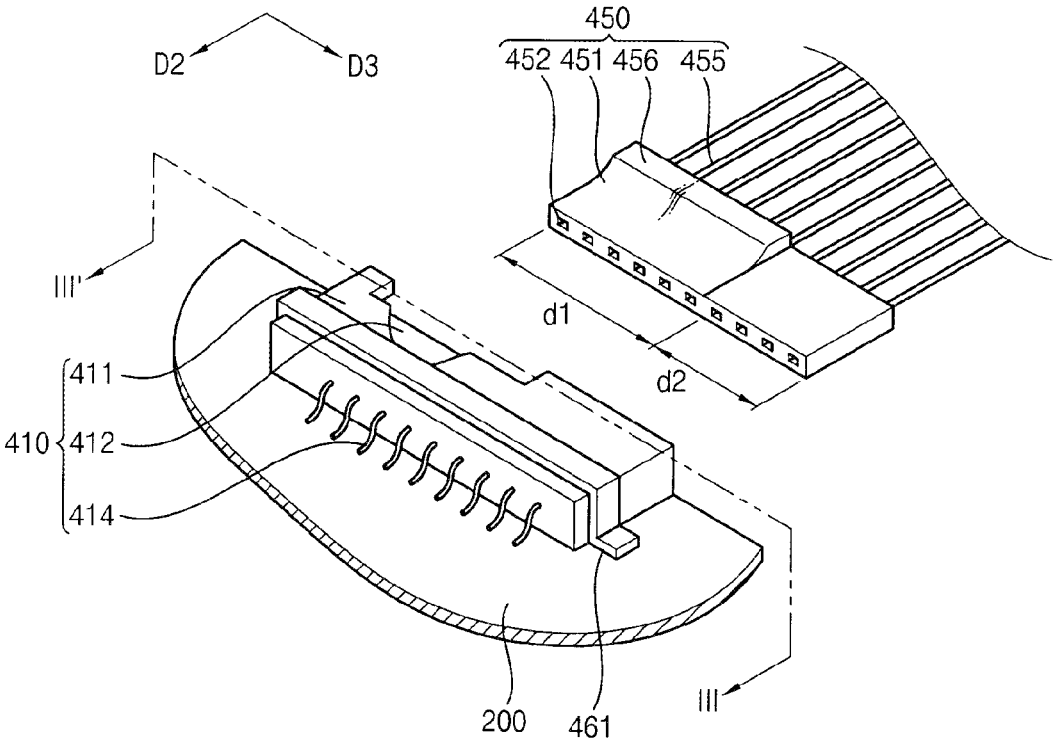
FIG. 10 is a perspective view illustrating a second exemplary embodiment of a connector unit according to the present invention.
Figure 11A:
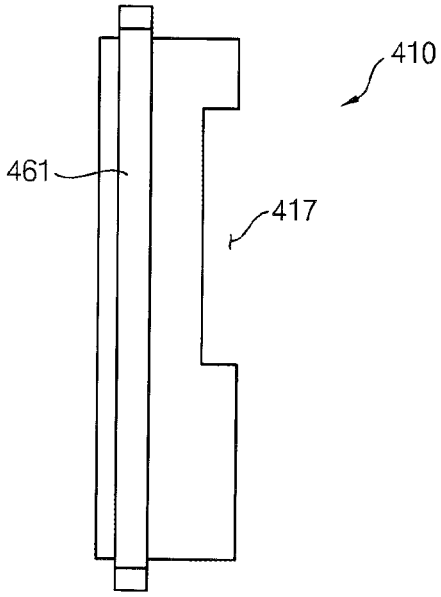
FIGS. 11A and 11B are top plan views illustrating first and second connectors, respectively of the connector unit in FIG. 10.
Figure 11B:
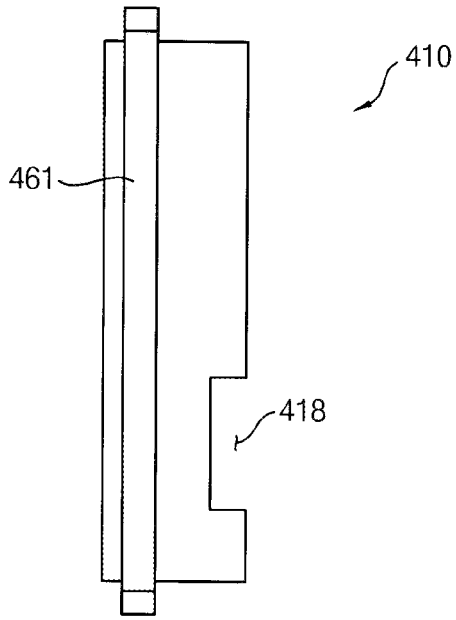
Figure 12:
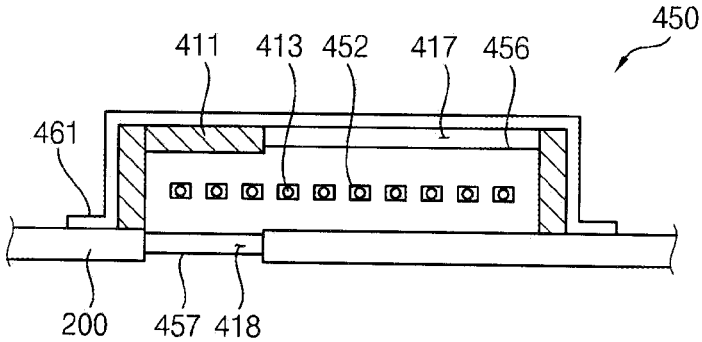
FIG. 12 is a cross-sectional view taken along line III-III' in FIG. 10.

FIG. 10 is a perspective view illustrating a connector unit according to the second exemplary embodiment described above. FIGS. 11A and 11B are plan views illustrating a first connector unit 410 of the connector unit in FIG. 10. FIG. 12 is a cross-sectional view taken along line III-III' in FIG. 10.

The second exemplary embodiment of the connector unit is substantially the same as the first exemplary embodiment of the connector unit described with reference to FIGS. 1 to 9 except for the first and second fixing protrusions 456 and 457, the positions of the first and second fixing grooves 417 and 418 and the shape of the fixing member 461. Thus, the same reference numerals are used for the same elements and repeated descriptions will be omitted.

Referring to FIGS. 10 to 12, the first fixing protrusion 456 is formed at one side of an edge of a top surface (for example, a right side as illustrated in FIG. 10) contacting a second side. The second side is opposite to a first side of the second connector body 451 where the pin hole 452 is formed.

The second fixing protrusion 457 is formed at the bottom surface of the second connector body 451 contacting the second side. The second fixing protrusion 457 is formed at the other side (for example, a left side as illustrated in FIG. 12). The other side is opposite to one side of a top surface where the first fixing protrusion 456 is formed.

A width d1 of the first fixing protrusion 456 and a width d2 of the second fixing protrusion 457 are different in a width direction D3 of the second connector 450 perpendicular to an insertion direction D2 of the receiving hole 412 formed at the first connector body 411. Thus, a user may easily perceive an insertion direction of the second connector 450 through the different widths d1 and d2 of the first fixing protrusion 456 and second fixing protrusion 457, respectively.

The first fixing groove 417 is formed at an upper edge of the receiving hole 412 corresponding to the first fixing protrusion 456. The second fixing groove 418 is formed at the lower edge of the receiving hole 412 corresponding to the second fixing protrusion 457, but is formed at the second side opposite to the first side of the upper edge.

Referring to FIGS. 10 and 12, the second connector 450 connects to the first connector 410, the first fixing protrusion 456 formed at the second connector 450 is inserted in the first fixing groove 417 formed at the first connector 410 and is fixed, the second fixing protrusion 457 is inserted in the second fixing groove 418 and is fixed. The pins 413 which are disposed at the receiving hole 412 of the first connector 410 are inserted in the pin holes 452 formed at the second connector body 451, thus electrically connecting the first and second connector units 410 and 450 together.

The fixing member 461 fixes the first connector body 411 to the source PCB 200 using the solder or the anisotropic conductive film (neither shown). The fixing member 461 is formed to expand an entire width of the surface of the first connector body 411. Opposite ends of the fixing member 461 are connected to the top surface of the source PCB 200 through the solder or the anisotropic conductive film.

In the present exemplary embodiment, the width d1 of the first fixing protrusion 456 is larger than the width d2 of the second fixing protrusion 457, for example, but is not intended to limit the scope of the present invention. Namely, the width d2 of the second fixing protrusion 457 may be larger than the width d1 of the first fixing protrusion 456. Also, in the present exemplary embodiment, the first fixing protrusion 456 is formed at the right edge of the top surface and the second fixing protrusion 457 is formed at the left edge of the top surface, for example, but is not intended to limit the scope of the present invention. Namely, the first and second fixing protrusions 456 and 457 may be asymmetrically formed.

Figure 13:
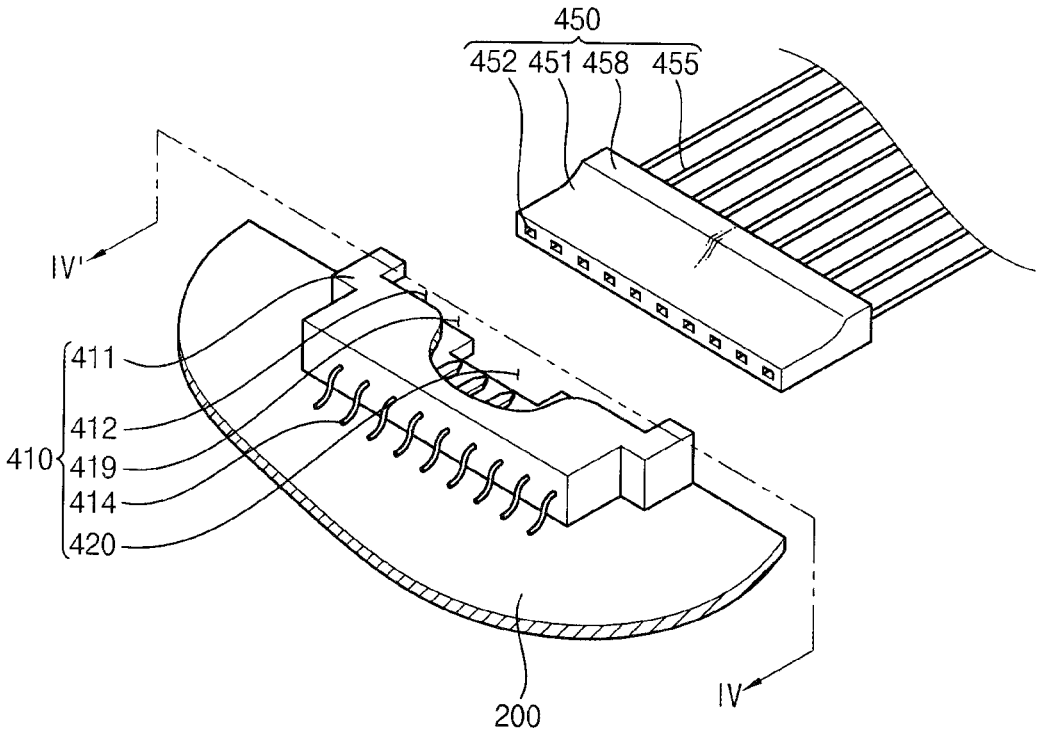
FIG. 13 is a perspective view illustrating a third exemplary embodiment of a connector unit according to the present invention.
Figure 14:
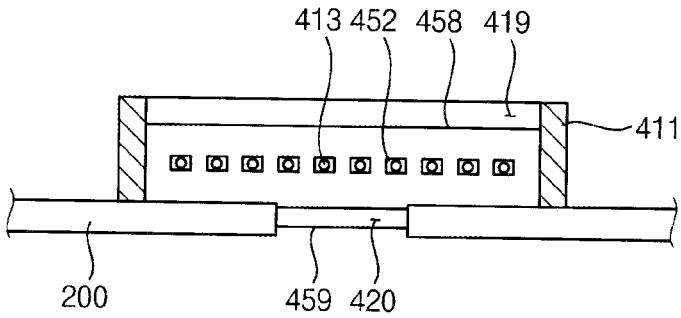
FIG. 14 is a cross-sectional view taken along line IV-IV' in FIG. 13.

FIG. 13 is a perspective view illustrating a third exemplary embodiment of a connector unit according to the present invention. FIG. 14 is a cross-sectional view taken along line IV-IV' of the connector unit in FIG. 13.

The connector unit of the third exemplary embodiment is substantially the same as the connector unit of the first exemplary embodiment described with reference to FIGS. 1 to 9 except for the first and second fixing protrusions 458 and 459, the position of the first and second fixing grooves 419 and 420. Thus, the same reference numerals are used for the same elements and repeated descriptions will be omitted.

Referring to FIGS. 13 and 14, a first fixing protrusion 458 is formed at the whole edge of a top surface contacting a second side. The second side is opposite to one side of the second connector body 451 where the pin hole 452 is formed.

The second fixing protrusion 459 is formed at the center of an edge of the bottom surface contacting the second side.

The first fixing groove 419 corresponding to the first fixing protrusion 458 is formed along an entire upper edge of the receiving hole 412. The second fixing groove 420 corresponding to the second fixing protrusion 459 is formed at the center of a lower edge of the receiving hole 412 of the first connector unit 410.

Referring to FIG. 14, the second connector 450 is connected to the first connector 410. The first fixing protrusion 458 formed at the second connector 450 is inserted in the first fixing groove 419 formed at the first connector 410 and is fixed. The second fixing protrusion 459 is inserted in the second fixing groove 420 and is fixed. The pins 413 which are disposed at the receiving hole 412 of the first connector 410 are inserted in the respective pin holes 452 formed at the second connector body 451, thus electrically connecting the first and second connector 410 and 450.

According to exemplary embodiments of the present invention, the shape of a second connector body where a first connector is inserted is asymmetrically formed, and the shape of the first connector is made to correspond to the shape of the second connector. Thus, the user may easily perceive the connection direction and orientation of the first and second connectors, and thereby connection errors of the first and second connectors may be prevented.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings, aspects, features and advantages of the present invention. Accordingly, all such modifications are intended to be included within the scope of the present invention as defined in the appended claims. In the claims, means-plus-function clauses are intended to cover the structures described herein as performing the recited function and not only structural equivalents, but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A connector unit comprising:

a first connector comprising a first connector body having a receiving hole, and a first terminal part disposed inside the receiving hole; and a second connector comprising:

a second connector body having a second terminal part being inserted into the receiving hole to be electrically connected to the first terminal part; and a first fixing protrusion disposed on one of top and bottom surfaces of the second connector body, the first fixing protrusion being adjacent to a first side edge at the one of top and bottom surfaces of the second connector body, wherein the first side edge of the second connector body is defined by one of two side edges parallel with a direction in which the second teminal part is inserted into the receiving hole.

2. The connector unit of claim 1, wherein the second connector further comprises a second fixing protrusion contacting a second side edge at the other one of top and bottom surfaces of the second connector body, the second side edge being opposite to the first side edge in a width direction perpendicular to an insertion direction of the second terminal part into the receiving hole.

3. The connector unit of claim 2, wherein a width of the first fixing protrusion is substantially different from a width of the second fixing protrusion in the width direction.

4. The connector unit of claim 2, wherein the first connector further comprises:

a first fixing groove corresponding to the first fixing protrusion disposed at one of an upper edge and a lower edge of the receiving hole; and a second fixing groove corresponding to the second fixing protrusion disposed at the other one of an upper edge and a lower edge of the receiving hole.

5. The connector unit of claim 1, wherein the first fixing protrusion contacts both side edges at the one of top and bottom surfaces of the second connector body.

6. The connector unit of claim 5, wherein a width of the first fixing protrusion is substantially the same as a width of the second connector body in a width direction perpendicular to an insertion direction of the second terminal part into the receiving hole.

7. The connector unit of claim 5, wherein the second connector further comprises a second fixing protrusion contacting none of both side edges at the other one of top and bottom surfaces of the second connector body.

8. The connector unit of claim 7, wherein the second fixing protrusion is disposed at a center of the other one of top and bottom surfaces of the second connector body.

9. The connector unit of claim 7, wherein the first connector further comprises:

a first fixing groove corresponding to the first fixing protrusion disposed at one of an upper edge and a lower edge of the receiving hole; and a second fixing groove corresponding to the second fixing protrusion disposed at the other one of an upper edge and a lower edge of the receiving hole.

10. The connector unit of claim 1, wherein the first connector is connectable to a printed circuit board.

11. A display device comprising:

a display panel which displays an image;

a printed circuit board providing a signal to the display panel; and a connector unit comprising:

a first connector comprising a first connector body having a receiving hole, and a first terminal part disposed inside the receiving hole; and a second connector comprising:

a second connector body having a second terminal part being inserted into the receiving hole to be electrically connected to the first terminal part; and a first fixing protrusion disposed on one of top and bottom surfaces of the second connector body, the first fixing protrusion being adjacent to a first side edge at the one of top and bottom surfaces of the second connector body, wherein the first said of the second connector body is defined by one of two said edges parallel with a direction in which the second terminal part is inserted into the receiving hole.

12. The display device of claim 11, wherein the first connector body is connectable to the printed circuit board.

13. The display device of claim 12, further comprising a fixing member disposed on the first connector body to fix the first connector body to the printed circuit board.

14. The display device of claim 13, wherein the fixing member comprises a conductive material.

15. The display device of claim 13, wherein the fixing member overlaps the first connector body in a direction perpendicular to the first terminal part.

16. The display device of claim 11, wherein the second connector further comprises a second fixing protrusion contacting a second side edge at the other one of top and bottom surfaces of the second connector body, the second side edge being opposite to the first side edge in a width direction perpendicular to an insertion direction of the second terminal part into the receiving hole.

17. The display device of claim 16, wherein a width of the first fixing protrusion is substantially different from a width of the second fixing protrusion in the width direction.

18. The display device of claim 11, wherein a width of the first fixing protrusion is substantially the same as a width of the second connector body in a width direction perpendicular to an insertion direction of the second terminal part into the receiving hole.

19. The display device of claim 18, wherein the second connector further comprises a second fixing protrusion contacting none of both side edges at the other one of top and bottom surfaces of the second connector body.

20. The display device of claim 18, wherein the second fixing protrusion is disposed at a center of the other one of top and bottom surfaces of the second connector body.

* * * * *